United States Patent [19]

Schreiber et al.

[11] Patent Number: 4,520,496

[45] Date of Patent: May 28, 1985

[54] ROTARY-ANODE X-RAY TUBE

[75] Inventors: Peter Schreiber, Rellingen; Klaus Huth, Hamburg, both of Fed. Rep. of Germany

[73] Assignee: U.S. Philips Corporation, New York, N.Y.

[21] Appl. No.: 511,377

[22] Filed: Jul. 6, 1983

[30] Foreign Application Priority Data

Jul. 17, 1982 [DE] Fed. Rep. of Germany ..... 3226858

[51] Int. Cl.[3] ..... H01J 35/10

[52] U.S. Cl. ..... 378/128; 378/129; 378/144

[58] Field of Search ..... 378/132, 133, 128, 129, 378/127, 144

[56] References Cited

U.S. PATENT DOCUMENTS 2,345,722 4/1944 Atlee ..... 378/128
2,489,080 11/1949 Combee ..... 378/133
4,063,124 12/1977 Appelt ..... 378/144
4,119,879 10/1978 Devine, Jr. ..... 378/129

FOREIGN PATENT DOCUMENTS 1337232 11/1973 United Kingdom .
2073945 10/1981 United Kingdom .

*Primary Examiner*—Alfred E. Smith
*Assistant Examiner*—T. N. Grigsby
*Attorney, Agent, or Firm*—Robert J. Kraus

[57] ABSTRACT

The invention relates to an anode disc for a rotary-anode X-ray tube which consists of a rotationally-symmetrical body of molybdenum and a corresponding body of graphite. The connection zone between the two bodies is smaller than the inner diameter of the focal path. Thanks to this construction the connection zone between the two bodies will not be thermally overloaded.

6 Claims, 1 Drawing Figure

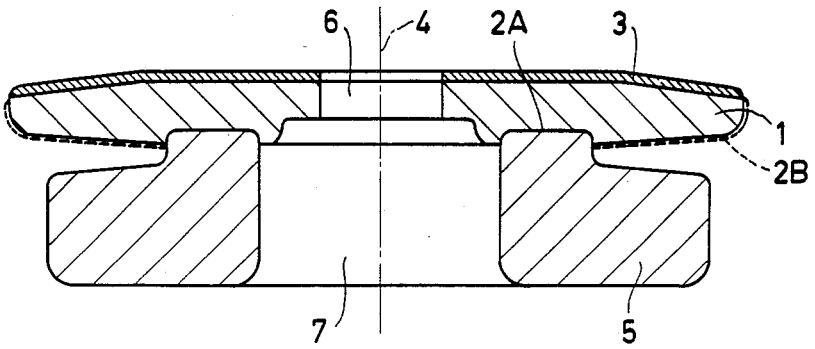
6
4
2A
3
1
2B
7
5

ROTARY-ANODE X-RAY TUBE

BACKGROUND OF THE INVENTION

The invention relates to a rotary-anode X-ray tube comprising an anode disc having a body which comprises two rotationally-symmetrical, interconnected parts which are adjacently situtated in the direction of the axis of rotation, a first part thereof being made of molybdenum or a molybdenum alloy whilst a second part is made of graphite, the volume of the second part amounting to at least one half of the volume of the first part.

A rotary-anode X-ray tube of this kind is known from DE-AS No. 21 17 956, FIG. 5, from DE-OS No. 30 13 441 corresponding to Bristish Patent No. 2,073,945 and from EP-OS No. 37 956. The graphite part and the molybdenum part thereof are interconnected by way of soldering, the outer diameter of the connection zone corresponding to the outer diameter of the first part and being larger than the diameter of the focal path. The volume of the graphite part must then amount to at least one half of the volume of the molybdenum part in order to achieve a substantially higher thermal loadability.

SUMMARY OF THE INVENTION

It is the object of the invention to provide a rotary-anode X-ray tube in which the loadability of the X-ray tube is increased with the same disc diameter and the same moment of inertia.

To this end, an X-ray tube of the kind set forth in accordance with the invention is characterized in that an outer diameter of a connection zone between the two parts is smaller than an inner diameter of the focal path. In this embodiment of the anode disc the temperature in the connection zone remains comparatively low so that a soldered connection at this area will be less readily thermally overloaded than in known rotary-anode X-ray tubes.

When an X-ray tube in accordance with the invention is subjected to a comparative high mean power, as is customary in computer tomography, the connection zone between the first and the second part remains substantially colder than in the known X-ray tubes, but the first part becomes hotter at the area of the focal path. In the case of an unfavorable choice of materials this could lead to detrimental deformation of this part. In a further embodiment in accordance with the invention such thermal deformation can be avoided in that the first part is made of an alloy of titanium, zirconium, molybdenum and carbon. Such an alloy is often referred to as a TZM-alloy.

The second part may in principle have a cylindrical shape, so that its outer diameter corresponds to the outer diameter of the connection zone. The dissipation of heat is improved in a further embodiment in accordance with the invention in that the second part which is made of graphite has an outer diameter which is larger than the outer diameter of the connection zone.

BRIEF DESCRIPTION OF THE DRAWINGS

The invention will be described in detail hereinafter with reference to the drawing which represents a sectional view of an anode disc in a plane containing the axis of rotation.

DESCRIPTION OF THE PREFERRED EMBODIMENT

The anode disc comprises a disc-shaped body 1 which in this case is made of a so-called TZM-alloy. On its upper side (the side facing the cathode in an assumed rotary-anode X-ray tube) the rotationally-symmetrical body 1, having an outer diameter of, for example 120 mm, is provided with a layer 3 of a tungsten-rhenium alloy, part of which (inner diameter 90 mm) forms the focal path. On its lower side the body 1 is provided with an annular recess 2*a* which is concentric with the axis of rotation 4 and whose outer diameter is smaller than the inner diameter of the focal path, for example, 80 mm. Outside this recess the lower side of the body 1 may be provided with a blackening layer 2B (for example, $Al_2O_3$ and $TiO_2$) in order to improve the emission properties. In the recess 2*a* there is embedded the end face of annular graphite body 5 which has an outer diameter for example, 110 mm, which is much larger than the recess 2 at some distance from the TZM body 1 or the recess 2; this outer diameter may in principle also correspond to the outer diameter of the TZM body 1. The dimensions of the body 5 in the axial direction amount to approximately 25 mm, whilst the corresponding dimensions of the TZM body 1 amount to approximately 8 mm.

The bodies 1 and 5 are interconnected by way of soldering. To this end, the body 1 is preferably positioned so that the recess 2 faces upwards. After deposition of a solder disc of the correct material, for example, zirconium, the graphite body 5 is arranged thereon. Subsequently at least the structure at the area of the recess 2 is heated until the two bodies 1 and 5 are mechanically rigidly interconnected after the softening of the solder ring. The connection zone thus formed corresponds to the recess.

When such a disc is subjected to a high mean continuous power (more than 600 W) so that the disc temperature (at the area of the focal path) reaches approximately 1500° C., the temperature thereof will remain below 1200° C. due to the comparatively large distance between the focal path and the recess 2, so that the strength of the solder layer does not deteriorate. If the outer radius of the connection zone between the bodies 1 and 5 were to be so large that it (or a part thereof) were situtated underneath the focal path like in the known rotary-anode X-ray tubes of the described kind, the temperature in the connection zone would be much higher; this could lead to the formation of carbides or even evaporation of the soldering agent, thus rendering the tube useless. Therefore, in such a case the mean power would have to be reduced so far that the temperature in the connection zone does not exceed the permissible value (approximately 1200° C.). The temperature of the TZM body 1 at the area of the focal path would then also be lower, i.e. the thermal loadability would by no means be used completely.

The TZM body 1 comprises a central bore 6 and the graphite body 5 comprises a central bore 7 whose diameter is larger than that of the bore 6. The TZM body 1 can thus be directly connected to the drive shaft (not shown) without the graphite body 5 being mechanically loaded by this connection.

What is claimed is:

1. A rotary-anode X-ray tube comprising an anode disc having a body which comprises first and second rotationally-symmetrical, interconnected parts which are adjacently situated in the direction of an axis of rotation, the first part bearing a focal path on a surface extending transversely of said axis and consisting essentially of molybdenum or a molybdenum alloy and the second part consisting essentially of graphite, the volume of the second part amounting to at least one half of the volume of the first part, characterized in that an outer diameter of a connection zone between the first and second parts is smaller than an inner diameter of the focal path.

2. A rotary-anode X-ray tube as claimed in claim 1, characterized in that the second part has an outer diameter which is larger than the outer diameter of the connection zone.

3. A rotary-anode X-ray tube as claimed in claim 1, characterized in that the first part consists essentially of titanium, zirconium, molybdenum and carbon.

4. A rotary-anode X-ray tube as claimed in claim 1, 2 or 3, characterized in that on a side which is remote from the focal path the first part comprises an annular recess into which the second part projects.

5. A rotary-anode X-ray tube as claimed in claim 1, 2 or 3, characterized in that on a side which is remote from the focal path the first part is provided, outside the connection zone, with a thermally emissive layer consisting essentially of $Al_2O_3$ and $TiO_2$.

6. A rotary-anode as in claim 4, characterized in that on a side which is remote from the focal path the first part is provided, outside the connection zone, with a thermally emissive layer consisting essentially of $Al_2O_3$ and $TiO_2$.

* * * * *